US011657825B2

(12) United States Patent
Sung

(10) Patent No.: US 11,657,825 B2
(45) Date of Patent: *May 23, 2023

(54) FRAME ERROR CONCEALMENT METHOD AND APPARATUS, AND AUDIO DECODING METHOD AND APPARATUS

(71) Applicant: SAMSUNG ELECTRONICS CO., LTD., Suwon-si (KR)

(72) Inventor: Ho-sang Sung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 102 days.

This patent is subject to a terminal disclaimer.

(21) Appl. No.: 17/217,663

(22) Filed: Mar. 30, 2021

(65) Prior Publication Data

US 2021/0217427 A1 Jul. 15, 2021

Related U.S. Application Data

(63) Continuation of application No. 16/673,005, filed on Nov. 4, 2019, now Pat. No. 10,984,803, which is a continuation of application No. 16/263,945, filed on Jan. 31, 2019, now Pat. No. 10,468,034, which is a continuation of application No. 13/657,054, filed on Oct. 22, 2012, now abandoned.

(60) Provisional application No. 61/549,953, filed on Oct. 21, 2011.

(51) Int. Cl.

| | |
|---|---|
| ***G10L 19/005*** | (2013.01) |
| ***G10L 19/00*** | (2013.01) |
| *G10L 19/22* | (2013.01) |

(52) U.S. Cl.

CPC ..... *G10L 19/0017* (2013.01); *G10L 19/005* (2013.01); *G10L 19/22* (2013.01)

(58) Field of Classification Search

CPC ..... G10L 19/005

See application file for complete search history.

(56) References Cited

U.S. PATENT DOCUMENTS

| | | | |
|---|---|---|---|
| 5,636,231 | A | 6/1997 | Huang et al. |
| 5,673,363 | A | 9/1997 | Jeon |
| 5,890,112 | A | 3/1999 | Kitabatake |
| 6,137,915 | A | 10/2000 | Chai |
| 6,327,689 | B1 | 12/2001 | Tian |

(Continued)

FOREIGN PATENT DOCUMENTS

| | | | |
|---|---|---|---|
| CN | 1199516 | A | 11/1998 |
| CN | 1484823 | A | 3/2004 |

(Continued)

OTHER PUBLICATIONS

Communication dated Feb. 15, 2021 issued by the Korean Intellectual Property Office in application No. 10-2020-0177444.

(Continued)

*Primary Examiner* — Feng-Tzer Tzeng

(74) *Attorney, Agent, or Firm* — Sughrue Mion, PLLC

(57) ABSTRACT

A frame error concealment method is provided that includes predicting a parameter by performing a regression analysis on a group basis for a plurality of groups formed from a first plurality of bands forming an error frame and concealing an error in the error frame by using the parameter predicted on a group basis.

7 Claims, 22 Drawing Sheets

(56) References Cited

U.S. PATENT DOCUMENTS

| | | | | |
|---|---|---|---|---|
| 6,658,112 | B1 * | 12/2003 | Barron | G10L 19/005 714/755 |
| 7,003,448 | B1 | 2/2006 | Lauber | |
| 7,031,926 | B2 | 4/2006 | Makinen | |
| 7,225,380 | B2 | 5/2007 | Toriumi | |
| 7,499,853 | B2 | 3/2009 | Yoshida et al. | |
| 7,590,525 | B2 | 9/2009 | Chen | |
| 7,809,556 | B2 * | 10/2010 | Goto | G10L 19/005 714/766 |
| 8,301,440 | B2 | 10/2012 | Zopf | |
| 8,320,265 | B2 | 11/2012 | Zhan et al. | |
| 8,369,416 | B2 | 2/2013 | Baik | |
| 8,397,117 | B2 | 3/2013 | Laaksonen et al. | |
| 8,612,218 | B2 | 12/2013 | Vary et al. | |
| 8,620,644 | B2 | 12/2013 | Ryu et al. | |
| 8,688,442 | B2 | 4/2014 | Miyasaka et al. | |
| 8,812,923 | B2 | 8/2014 | Macours | |
| 8,843,798 | B2 | 9/2014 | Sung et al. | |
| 8,892,228 | B2 | 11/2014 | Muesch | |
| 2002/0133764 | A1 | 9/2002 | Wang | |
| 2003/0036382 | A1 | 2/2003 | Chen | |
| 2004/0010407 | A1 | 1/2004 | Kovesi et al. | |
| 2007/0027683 | A1 | 2/2007 | Sung et al. | |
| 2007/0064812 | A1 | 3/2007 | Baik | |
| 2007/0198254 | A1 | 8/2007 | Goto et al. | |
| 2008/0071530 | A1 | 3/2008 | Ehara | |
| 2008/0126096 | A1 | 5/2008 | Oh et al. | |
| 2008/0126904 | A1 * | 5/2008 | Sung | G10L 19/005 714/E11.03 |
| 2009/0281797 | A1 | 11/2009 | Zopf | |
| 2010/0115370 | A1 | 5/2010 | Laaksonen et al. | |
| 2013/0144632 | A1 | 6/2013 | Sung | |
| 2013/0332152 | A1 | 12/2013 | Lecomte | |
| 2020/0066284 | A1 | 2/2020 | Sung | |

FOREIGN PATENT DOCUMENTS

| | | | |
|---|---|---|---|
| CN | 1893665 | A | 1/2007 |
| CN | 101046964 | A | 10/2007 |
| CN | 101346760 | A | 1/2009 |
| CN | 101399040 | A | 4/2009 |
| CN | 102057423 | A | 5/2011 |
| CN | 102057424 | A | 5/2011 |
| CN | 102122511 | A | 7/2011 |
| CN | 102171753 | A | 8/2011 |
| CN | 104011793 | A | 8/2014 |
| EP | 1339041 | A1 | 7/2009 |
| EP | 2450885 | A1 | 5/2012 |
| JP | 2001-13998 | A | 1/2001 |
| JP | 2003-99096 | | 4/2003 |
| JP | 200399096 | A | 4/2003 |
| JP | 2004-361731 | A | 12/2004 |
| JP | 2005-266458 | A | 9/2005 |
| JP | 2010-511201 | A | 4/2010 |
| JP | 2011-75936 | A | 4/2011 |
| JP | 2014531056 | A | 11/2014 |
| KR | 1020060124371 | A | 12/2006 |
| KR | 1020070003502 | A | 1/2007 |
| KR | 1020080048317 | A | 6/2008 |
| KR | 10-0862662 | B1 | 10/2008 |
| WO | 9709791 | A1 | 3/1997 |
| WO | 2008066264 | A1 | 6/2008 |

OTHER PUBLICATIONS

Communication dated Dec. 31, 2020 issued by the State Intellectual Property Office of the P.R. China in application No. 201610930358.3.

Communication dated Apr. 1, 2021 issued by the Korean Intellectual Property Office in application No. 10-2020-0007381.

Communication dated Feb. 3, 2020, issued by the State Intellectual Property Office of the P.R. China in application No. 201610930358.3.

Communication dated Feb. 3, 2020, issued by the State Intellectual Property Office of the P.R China in application No. 201610930035.4.

"Low-complexity, full-band audio coding for high-quality, conversational applications", Series G: Transmission Systems and Media, Digital Systems and Networks: Digital terminal equipments—Coding of analogue signals, ITU-T, G.719, Jun. 2008, 58 pages.

"Digital cellular telecommunications system (Phase 2+); Universal Mobile Telecommunications System (UMTS); General audio codec audio processing functions; Enhanced aacPlus general audio codec; Additional decoder tools", Global System for Mobile Communications, (3GPP TS 26.402 version 6.1.0 Release 6), Sep. 2005, ETSI TS 126 402, pp. 1-18 (19 pages).

Communication dated Apr. 3, 2019 issued by the Korean Intellectual Property Office in counterpart Korean Application No. 10-2012-0117510.

Marina Bosi, et al., "ISO/IEC MPEG-2 Advanced Audio Coding", Journal of the Audio Engineering Society, vol. 45, No. 10, Oct. 1997, p. 789-814, 26 pages total.

"Digital cellular telecommunications system (Phase 2+); Universal Mobile Telecommunications System (UMTS); General audio codec audio processing functions; Enhanced aacPlus general audio codec; Additional decoder tools", 3GPP TS 26.402, version 6.1.0, Release 6, Sep. 2005, p. 1-18, 19 pages total.

Communication dated Jul. 4, 2017 issued by the Japanese Patent Office in counterpart Japanese Patent Application No. 2016-139585.

Communication dated Sep. 29, 2015, issued by the Japanese Patent Office in counterpart Japanese Patent Application No. 2014-537002.

Communication dated Oct. 8, 2015, issued by the Mexican Institute of Industrial Property in counterpart Mexican Patent Application No. MX/a/2014/004796.

Communication dated Nov. 27, 2015, issued by the State Intellectual Property Office of the People's Republic of China in counterpart Chinese Patent Application No. 201280063727.3.

Communication dated Apr. 24, 2015 by the Mexican Intellectual Patent Office in related Application No. MX/a/2014/004796.

Communication dated May 8, 2015 by the European Patent Office in related Application No. 12841681.5.

Cho et al., "A Packet Loss Concealment Algorithm Robust to Burst Packet Loss for CELP-type Speech Coders", The 23rd International Technical Conference on Circuits/Systems, Computers and Communications (ITC-CSCC 2008), Jul. 1, 2008, 4 total pages.

Choi et al., "A Nonlinear Regression Analysis Method for Frame Erasure Concealment in VoIP Networks", May 18, 2009, retrieved from <URL:http://ocean.ki sti.re.kr/downfile/volu me/iwi tt/OTNBBE/2O09/v9n5/0TNBBE_2009_v9n5 129.pdf>, 4 total pages.

International Search Report (PCT/ISA/210 & PCT/ISA/220) dated Mar. 27, 2013 by the International Searching authority in counterpart application No. PCT/KR2012/008689.

Ryu, "Encoder Assisted Frame Loss Concealment for MPEG-AAC Decoder," IEEE ICASSP, 2006.

Communication dated Nov. 6, 2018, issued by the Japanese Patent Office in counterpart Japanese Patent Application No. 2017-235512.

Communication dated Oct. 18, 2019 issued by the Korean Intellectual Property Office in counterpart Korean Application No. 10-2012-0117510.

Jeremie Lecomte et al. "Packet-loss concealment technology advances in EVS". IEEE International Conference on Acoustics, Speech and Signal Processing, Apr. 19, 2015.

* cited by examiner

FRAME ERROR CONCEALMENT METHOD AND APPARATUS, AND AUDIO DECODING METHOD AND APPARATUS

CROSS-REFERENCE TO RELATED PATENT APPLICATION

This application is a continuation application of U.S. application Ser. No. 16/673,005, filed Nov. 4, 2019, which is a continuation application of U.S. application Ser. No. 16/263,945, filed on Jan. 31, 2019, which is a continuation application of U.S. application Ser. No. 13/657,054, filed Oct. 22, 2012, which claims the benefit of U.S. Provisional Application No. 61/549,953 filed on Oct. 21, 2011 in the U.S. Patent Trademark Office, the disclosures of which are incorporated by reference herein in their entirety.

BACKGROUND

1. Field

The present disclosure relates to frame error concealment, and more particularly, to a frame error concealment method and apparatus for accurately restoring an error frame to be adaptive to signal characteristics without an additional delay at low complexity in a frequency domain, an audio decoding method and apparatus, and a multimedia device employing the same.

2. Description of the Related Art

When an encoded audio signal is transmitted through a wired or wireless network, if a certain packet is damaged or distorted due to an error on the transmission, an error may occur in a certain frame of a decoded audio signal. In this case, if the error, which has occurred in the frame, is not properly processed, sound quality of the decoded audio signal may decrease in a duration of the frame in which the error has occurred (hereinafter, referred to as an error frame).

Examples of a method of concealing a frame error are a muting method of weakening an influence of an error on an output signal by reducing an amplitude of a signal in an error frame, a repetition method of reconstructing a signal of an error frame by repeatedly reproducing a previous good frame (PGF), an interpolation method of estimating a parameter of an error frame by interpolating parameters of a PGF and a next good frame (NGF), an extrapolation method of obtaining a parameter of an error frame by extrapolating a parameter of a PGF, and a regression analysis method of obtaining a parameter of an error frame by performing a regression analysis of a parameter of a PGF.

However, conventionally, since an error frame is restored by uniformly applying a same method regardless of characteristics of an input signal, a frame error cannot be efficiently concealed, thereby resulting in a decrease in sound quality. In addition, in the interpolation method, although a frame error can be efficiently concealed, an additional delay of one frame is necessary, and thus, it is not proper to use the interpolation method in a delay sensitive codec for communication. In addition, in the regression analysis method, although a frame error can be concealed by somewhat considering existing energy, a decrease in efficiency may occur when an amplitude of a signal gradually increases or a change in a signal is severe. In addition, in the regression analysis method, when a regression analysis is performed on a band basis in a frequency domain, an unintended signal may be estimated due to an instantaneous change in energy of each band.

SUMMARY

It is an aspect to provide a frame error concealment method and apparatus for accurately restoring an error frame to be adaptive to signal characteristics without an additional delay at low complexity in a frequency domain.

It is another aspect to provide an audio decoding method and apparatus for minimizing a decrease in sound quality due to a frame error by accurately restoring an error frame to be adaptive to signal characteristics without an additional delay at low complexity in a frequency domain, a recording medium storing the same, and a multimedia device employing the same.

It is another aspect to provide a computer-readable recording medium storing a computer-readable program for executing the frame error concealment method or the audio decoding method.

It is another aspect to provide a multimedia device employing the frame error concealment apparatus or the audio decoding apparatus.

According to an aspect of one or more exemplary embodiments, there is provided a frame error concealment method comprising: predicting a parameter by performing a regression analysis on a group basis for a plurality of groups formed from a first plurality of bands forming an error frame; and concealing an error in the error frame by using the parameter predicted on a group basis.

According to another aspect of one or more exemplary embodiments, there is provided an audio decoding method comprising: acquiring a spectral coefficient by decoding a good frame; predicting a parameter by performing a regression analysis on a group basis for a plurality of groups formed from a first plurality of bands forming an error frame and acquiring a spectral coefficient of the error frame by using the parameter predicted on a group basis; and transforming a decoded spectral coefficient of the good frame or the error frame into a time domain and reconstructing a signal in the time domain by performing an overlap-and-add process.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1A:
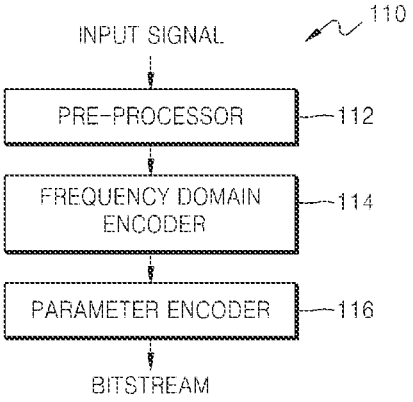
FIGS. 1A and 1B are block diagrams of an audio encoding apparatus and an audio decoding apparatus, respectively, according to an exemplary embodiment.

The present inventive concept may allow various kinds of change or modification and various changes in form, and specific exemplary embodiments will be illustrated in drawings and described in detail in the specification. However, it should be understood that the specific exemplary embodiments do not limit the present inventive concept to a specific form but include every modified, equivalent, or replaced form within the spirit and technical scope of the present inventive concept. In the following description, well-known functions or constructions are not described in detail since they would obscure the inventive concept with unnecessary detail.

Although terms, such as 'first' and 'second', can be used to describe various elements, the elements cannot be limited by the terms. The terms can be used to distinguish a certain element from another element.

The terminology used in the application is used only to describe specific exemplary embodiments and does not have any intention to limit the inventive concept. Although general terms as currently widely used as possible are selected as the terms used in the present inventive concept while taking functions in the present inventive concept into account, they may vary according to an intention of those of ordinary skill in the art, judicial precedents, or the appearance of new technology. In addition, in specific cases, terms intentionally selected by the applicant may be used, and in this case, the meaning of the terms will be disclosed in corresponding description of the inventive concept. Accordingly, the terms used in the present disclosure should be defined not by simple names of the terms but by the meaning of the terms and the content over the present inventive concept.

An expression in the singular includes an expression in the plural unless they are clearly different from each other in context. In the application, it should be understood that terms, such as 'include' and 'have', are used to indicate the existence of implemented feature, number, step, operation, element, part, or a combination of them without excluding in advance the possibility of existence or addition of one or more other features, numbers, steps, operations, elements, parts, or combinations of them.

The present inventive concept will now be described more fully with reference to the accompanying drawings, in which exemplary embodiments are shown. Like reference numerals in the drawings denote like elements, and thus their repetitive description will be omitted.

Figure 1B:
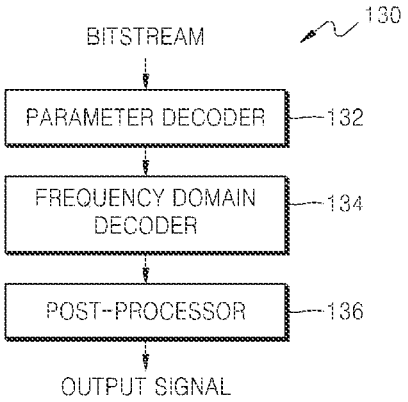

FIGS. 1A and 1B are block diagrams of an audio encoding apparatus 110 and an audio decoding apparatus 130, respectively, according to an exemplary embodiment.

The audio encoding apparatus 110 shown in FIG. 1A may include a pre-processor 112, a frequency domain encoder 114, and a parameter encoder 116. The components may be integrated in at least one module and be implemented as at least one processor (not shown).

Referring to FIG. 1A, the pre-processor 112 may perform filtering or down-sampling of an input signal but is not limited thereto. The input signal may include a speech signal, a music signal, or a signal in which speech and music are mixed. Hereinafter, the input signal is referred to as an audio signal for convenience of description.

The frequency domain encoder 114 may perform a time-frequency transform on the audio signal provided from the pre-processor 112, select an encoding tool in correspondence with the number of channels, an encoding band, and a bit rate of the audio signal, and encode the audio signal by using the selected encoding tool. The time-frequency transform may be performed using a modified discrete cosine transform (MDCT) or a fast Fourier transform (FFT) but is not limited thereto. If a given number of bits are sufficient, a general transform encoding method may be used for all bands. Otherwise, if a given number of bits are insufficient, a bandwidth extension (BWE) method may be applied to some bands. When the audio signal is a stereo audio signal or a multi-channel audio signal, if a given number of bits are sufficient, encoding may be performed on each channel. Otherwise, if a given number of bits are insufficient, a down-mixing method may be applied. The frequency domain encoder 114 may generate encoded spectral coefficients.

The parameter encoder 116 may extract parameters from the encoded spectral coefficients provided from the frequency domain encoder 114 and encode the extracted parameters. The parameters may be extracted on a sub-band basis, and each sub-band may be a unit of grouping spectral coefficients and may have a uniform or non-uniform length by reflecting a threshold band. When each sub-band has a non-uniform length, a sub-band existing in a low-frequency band may have a relatively short length as compared with a sub-band in a high-frequency band. The number and length of sub-bands included in one frame may vary according to a codec algorithm and may affect an encoding performance. Each of the parameters may be, for example, a scale factor, power, mean energy, or norm of a sub-band but is not limited thereto. The spectral coefficients and the parameters obtained as a result of the encoding may form a bitstream and be transmitted in the form of packets through a channel or stored in a storage medium.

The audio decoding apparatus 130 shown in FIG. 1B may include a parameter decoder 132, a frequency domain decoder 134, and a post-processor 136. The frequency domain decoder 134 may include a frame error concealment algorithm. The components may be integrated in at least one module and be implemented as at least one processor (not shown).

Referring to FIG. 1B, the parameter decoder 132 may decode parameters from a bitstream transmitted in the form of packets and check the decoded parameters whether an error has occurred on a frame basis. The error check may be performed using various well-known methods, and information on whether a current frame is a good frame or an error frame is provided to the frequency domain decoder 134.

The frequency domain decoder 134 may generate synthesized spectral coefficients by decoding the current frame through a general transform decoding process when the current frame is a good frame and may generate synthesized spectral coefficients by scaling a spectral coefficient of a previous good frame (PGF) through the frame error concealment algorithm in a frequency domain when the current frame is an error frame. The frequency domain decoder 134 may generate a time domain signal by performing a frequency-time transform on synthesized spectral coefficients.

The post-processor 136 may perform filtering or upsampling on the time domain signal provided from the frequency domain decoder 134 but is not limited thereto. The post-processor 136 provides a reconstructed audio signal as an output signal.

Figure 2A:
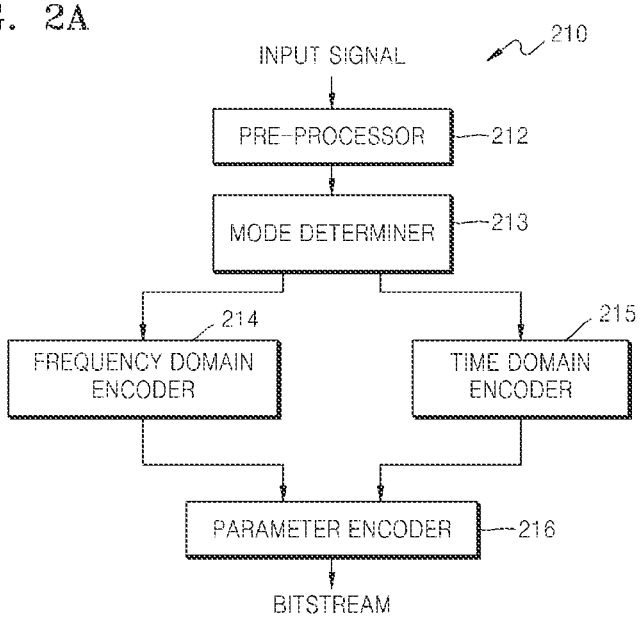
FIGS. 2A and 2B are block diagrams of an audio encoding apparatus and an audio decoding apparatus, respectively, according to another exemplary embodiment.
Figure 2B:
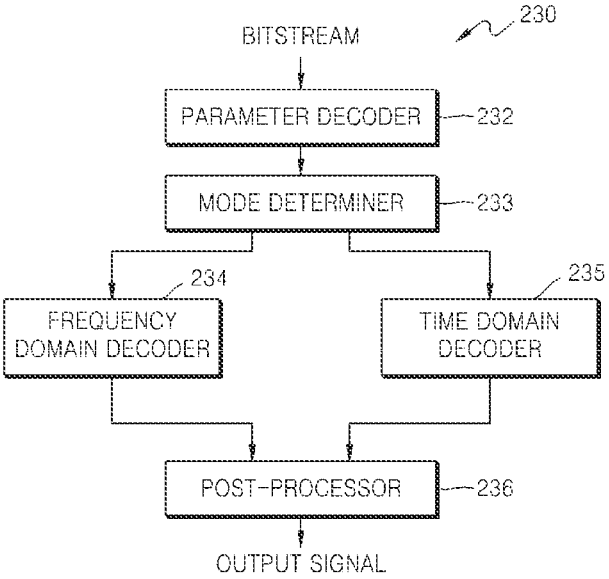

FIGS. 2A and 2B are block diagrams of an audio encoding apparatus 210 and an audio decoding apparatus 230, respectively, according to another exemplary embodiment, wherein the audio encoding apparatus 210 and the audio decoding apparatus 230 may have a switching structure.

The audio encoding apparatus 210 shown in FIG. 2A may include a pre-processor 212, a mode determiner 213, a frequency domain encoder 214, a time domain encoder 215, and a parameter encoder 216. The components may be integrated in at least one module and be implemented as at least one processor (not shown).

Referring to FIG. 2A, since the pre-processor 212 is substantially the same as the pre-processor 112 of FIG. 1A, a description thereof is omitted.

The mode determiner 213 may determine an encoding mode by referring to characteristics of an input signal. According to the characteristics of the input signal, it may be determined whether a current frame is in a speech mode or a music mode, and it may also be determined whether an encoding mode that is efficient for the current frame is a time domain mode or a frequency domain mode. The characteristics of the input signal may be obtained using short-term characteristics of a frame or long-term characteristics of a plurality of frames, but the obtaining of the characteristics of the input signal is not limited thereto. The mode determiner 213 provides an output signal of the pre-processor 212 to the frequency domain encoder 214 when the characteristics of the input signal correspond to the music mode or the frequency domain mode and provides the output signal of the pre-processor 212 to the time domain encoder 215 when the characteristics of the input signal correspond to the speech mode or the time domain mode.

Since the frequency domain encoder 214 is substantially the same as the frequency domain encoder 114 of FIG. 1A, a description thereof is omitted.

The time domain encoder 215 may perform code-excited linear prediction (CELP) encoding on an audio signal provided from the pre-processor 212. In detail, algebraic CELP (ACELP) may be used, but the CELP encoding is not limited thereto. The time domain encoder 215 generates encoded spectral coefficients.

The parameter encoder 216 may extract parameters from the encoded spectral coefficients provided from the frequency domain encoder 214 or the time domain encoder 215 and encode the extracted parameters. Since the parameter encoder 216 is substantially the same as the parameter encoder 116 of FIG. 1A, a description thereof is omitted. The spectral coefficients and the parameters obtained as a result of the encoding may form a bitstream together with encoding mode information and be transmitted in the form of packets through a channel or stored in a storage medium.

The audio decoding apparatus 230 shown in FIG. 2B may include a parameter decoder 232, a mode determiner 233, a frequency domain decoder 234, a time domain decoder 235, and a post-processor 236. Each of the frequency domain decoder 234 and the time domain decoder 235 may include a frame error concealment algorithm in a corresponding domain. The components may be integrated in at least one module and be implemented as at least one processor (not shown).

Referring to FIG. 2B, the parameter decoder 232 may decode parameters from a bitstream transmitted in the form of packets and check the decoded parameters whether an error has occurred on a frame basis. The error check may be performed using various well-known methods, and information on whether a current frame is a good frame or an error frame is provided to the frequency domain decoder 234 or the time domain decoder 235.

The mode determiner 233 may check encoding mode information included in the bitstream and provide the current frame to the frequency domain decoder 234 or the time domain decoder 235.

The frequency domain decoder 234 may operate when an encoding mode is the music mode or the frequency domain mode and generate synthesized spectral coefficients by decoding the current frame through a general transform decoding process if the current frame is a good frame. Otherwise, if the current frame is an error frame, and an encoding mode of a previous frame is the music mode or the frequency domain mode, the frequency domain decoder 234 may generate synthesized spectral coefficients by scaling a spectral coefficient of the PGF through the frame error concealment algorithm in the frequency domain. The frequency domain decoder 234 may generate a time domain signal by performing a frequency-time transform on synthesized spectral coefficients.

The time domain decoder 235 may operate when an encoding mode is the speech mode or the time domain mode and generate a time domain signal by decoding the current frame through a general CELP decoding process if the current frame is a good frame. Otherwise, if the current frame is an error frame, and an encoding mode of a previous frame is the speech mode or the time domain mode, the time domain decoder 235 may perform a frame error concealment algorithm in the time domain.

The post-processor 236 may perform filtering or upsampling on the time domain signal provided from the frequency domain decoder 234 or the time domain decoder 235 but is not limited thereto. The post-processor 236 provides a reconstructed audio signal as an output signal.

Figure 3A:
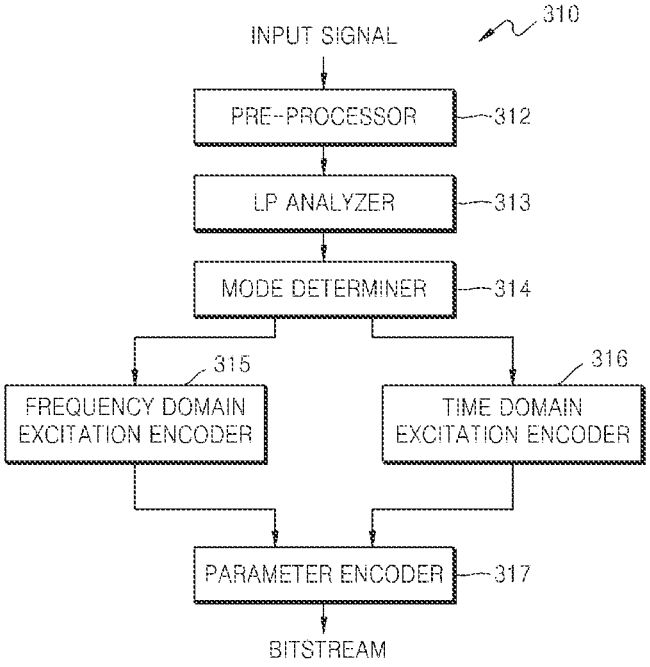
FIGS. 3A and 3B are block diagrams of an audio encoding apparatus and an audio decoding apparatus, respectively, according to another exemplary embodiment.
Figure 3B:
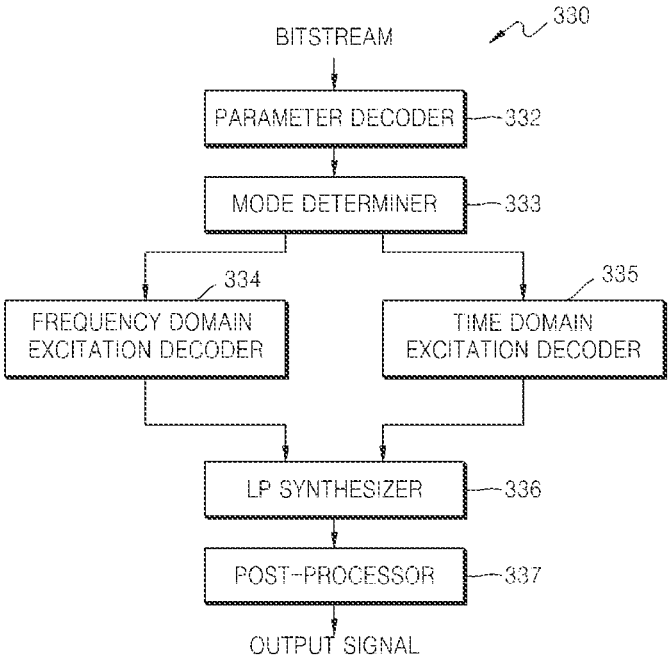

FIGS. 3A and 3B are block diagrams of an audio encoding apparatus 310 and an audio decoding apparatus 330, respectively, according to another exemplary embodiment, wherein the audio encoding apparatus 310 and the audio decoding apparatus 330 may have a switching structure.

The audio encoding apparatus 310 shown in FIG. 3A may include a pre-processor 312, a linear prediction (LP) analyzer 313, a mode determiner 314, a frequency domain excitation encoder 315, a time domain excitation encoder 316, and a parameter encoder 317. The components may be integrated in at least one module and be implemented as at least one processor (not shown).

Referring to FIG. 3A, since the pre-processor 312 is substantially the same as the pre-processor 112 of FIG. 1A, a description thereof is omitted.

The LP analyzer 313 may extract LP coefficients by performing an LP analysis on an input signal and generate an excitation signal from the extracted LP coefficients. The excitation signal may be provided to one of the frequency domain excitation encoder 315 and the time domain excitation encoder 316 according to an encoding mode.

Since the mode determiner 314 is substantially the same as the mode determiner 213 of FIG. 2A, a description thereof is omitted.

The frequency domain excitation encoder 315 may operate when the encoding mode is the music mode or the frequency domain mode, and since the frequency domain excitation encoder 315 is substantially the same as the frequency domain encoder 114 of FIG. 1A, except that an input signal is the excitation signal, a description thereof is omitted.

The time domain excitation encoder 316 may operate when the encoding mode is the speech mode or the time domain mode, and since the time domain excitation encoder 316 is substantially the same as the time domain encoder 215 of FIG. 2A, except that an input signal is the excitation signal, a description thereof is omitted.

The parameter encoder 317 may extract parameters from the encoded spectral coefficients provided from the frequency domain excitation encoder 315 or the time domain excitation encoder 316 and encodes the extracted parameters. Since the parameter encoder 317 is substantially the same as the parameter encoder 116 of FIG. 1A, a description thereof is omitted. The spectral coefficients and the parameters obtained as a result of the encoding may form a bitstream together with encoding mode information and be transmitted in the form of packets through a channel or stored in a storage medium.

The audio decoding apparatus 330 shown in FIG. 3B may include a parameter decoder 332, a mode determiner 333, a frequency domain excitation decoder 334, a time domain excitation decoder 335, an LP synthesizer 336, and a post-processor 337. Each of the frequency domain excitation decoder 334 and the time domain excitation decoder 335 may include a frame error concealment algorithm in a corresponding domain. The components may be integrated in at least one module and be implemented as at least one processor (not shown).

Referring to FIG. 3B, the parameter decoder 332 may decode parameters from a bitstream transmitted in the form of packets and check the decoded parameters whether an error has occurred on a frame basis. The error check may be performed using various well-known methods, and information on whether a current frame is a good frame or an error frame is provided to the frequency domain excitation decoder 334 or the time domain excitation decoder 335.

The mode determiner 333 may check encoding mode information included in the bitstream and provide the current frame to the frequency domain excitation decoder 334 or the time domain excitation decoder 335.

The frequency domain excitation decoder 334 may operate when an encoding mode is the music mode or the frequency domain mode and generate synthesized spectral coefficients by decoding the current frame through a general transform decoding process if the current frame is a good frame. Otherwise, if the current frame is an error frame, and an encoding mode of a previous frame is the music mode or the frequency domain mode, the frequency domain excitation decoder 334 may generate synthesized spectral coefficients by scaling spectral coefficients of the PGF through the frame error concealment algorithm in the frequency domain. The frequency domain excitation decoder 334 may generate an excitation signal that is a time domain signal by performing a frequency-time transform on synthesized spectral coefficients.

The time domain excitation decoder 335 may operate when an encoding mode is the speech mode or the time domain mode and generates an excitation signal that is a time domain signal by decoding the current frame through a general CELP decoding process if the current frame is a good frame. Otherwise, if the current frame is an error frame, and an encoding mode of a previous frame is the speech mode or the time domain mode, the time domain excitation decoder 335 may perform a frame error concealment algorithm in the time domain.

The LP synthesizer 336 may generate a time domain signal by performing an LP synthesis on the excitation signal provided from the frequency domain excitation decoder 334 or the time domain excitation decoder 335.

The post-processor 337 may perform filtering or up-sampling on the time domain signal provided from the LP synthesizer 336 but is not limited thereto. The post-processor 337 provides a reconstructed audio signal as an output signal.

Figure 4A:
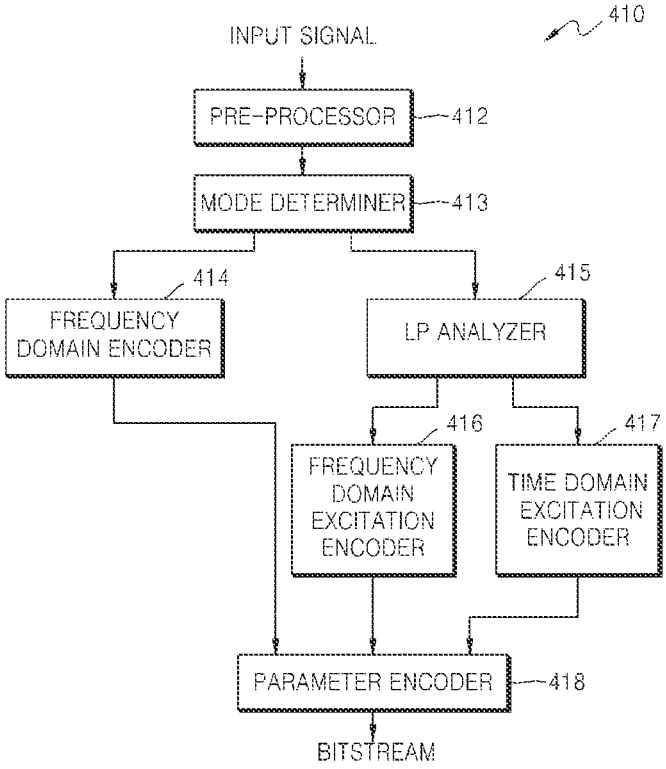
FIGS. 4A and 4B are block diagrams of an audio encoding apparatus and an audio decoding apparatus, respectively, according to another exemplary embodiment.
Figure 4B:
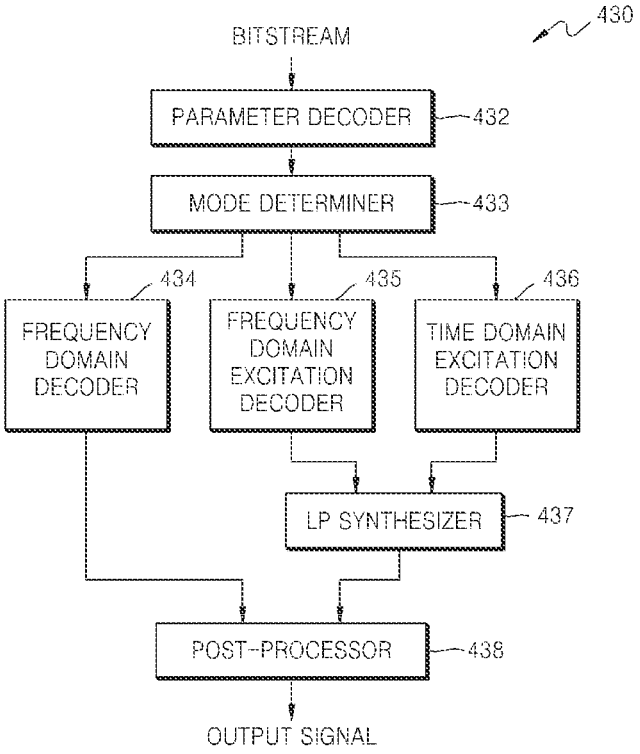

FIGS. 4A and 4B are block diagrams of an audio encoding apparatus 410 and an audio decoding apparatus 430, respectively, according to another exemplary embodiment, wherein the audio encoding apparatus 410 and the audio decoding apparatus 430 may have a switching structure.

The audio encoding apparatus 410 shown in FIG. 4A may include a pre-processor 412, a mode determiner 413, a frequency domain encoder 414, an LP analyzer 415, a frequency domain excitation encoder 416, a time domain excitation encoder 417, and a parameter encoder 418. The components may be integrated in at least one module and be implemented as at least one processor (not shown). Since the audio encoding apparatus 410 shown in FIG. 4A may be derived by combining the audio encoding apparatus 210 shown in FIG. 2A and the audio encoding apparatus 310 shown in FIG. 3A, an operational description of common parts is omitted, and an operation of the mode determiner 413 will now be described.

The mode determiner 413 may determine an encoding mode of an input signal by referring to characteristics and a bit rate of the input signal. The mode determiner 413 may determine a CELP mode or another mode according to whether a current frame according to the characteristics of the input signal is in the speech mode or the music mode and whether an encoding mode that is efficient for the current frame is the time domain mode or the frequency domain mode. If the characteristics of the input signal correspond to the speech mode, the CELP mode may be determined, if the characteristics of the input signal correspond to the speech mode and a high bit rate, the frequency domain mode may be determined, and if the characteristics of the input signal correspond to the music mode and a low bit rate, an audio mode may be determined. The mode determiner 413 may provide the input signal to the frequency domain encoder 414 in the frequency domain mode, to the frequency domain excitation encoder 416 via the LP analyzer 415 in the audio mode, and to the time domain excitation encoder 417 via the LP analyzer 415 in the CELP mode.

The frequency domain encoder 414 may correspond to the frequency domain encoder 114 of the audio encoding apparatus 110 of FIG. 1A or the frequency domain encoder 214 of the audio encoding apparatus 210 of FIG. 2A, and the frequency domain excitation encoder 416 or the time domain excitation encoder 417 may correspond to the frequency domain excitation encoder 315 or the time domain excitation encoder 316 of the audio encoding apparatus 310 of FIG. 3A.

The audio decoding apparatus 430 shown in FIG. 4B may include a parameter decoder 432, a mode determiner 433, a frequency domain decoder 434, a frequency domain excitation decoder 435, a time domain excitation decoder 436, an LP synthesizer 437, and a post-processor 438. Each of the frequency domain decoder 434, the frequency domain excitation decoder 435, and the time domain excitation decoder 436 may include a frame error concealment algorithm in a corresponding domain. The components may be integrated in at least one module and be implemented as at least one processor (not shown). Since the audio decoding apparatus 430 shown in FIG. 4B may be derived by combining the audio decoding apparatus 230 shown in FIG. 2B and the audio decoding apparatus 330 shown in FIG. 3B, an operational description of common parts is omitted, and an operation of the mode determiner 433 will now be described.

The mode determiner 433 may check encoding mode information included in a bitstream and provide a current frame to the frequency domain decoder 434, the frequency domain excitation decoder 435, or the time domain excitation decoder 436.

The frequency domain decoder 434 may correspond to the frequency domain decoder 134 of the audio decoding apparatus 130 of FIG. 1B or the frequency domain decoder 234 of the audio decoding apparatus 230 of FIG. 2B, and the frequency domain excitation decoder 435 or the time domain excitation decoder 436 may correspond to the frequency domain excitation decoder 334 or the time domain excitation decoder 335 of the audio decoding apparatus 330 of FIG. 3B.

Figure 5:
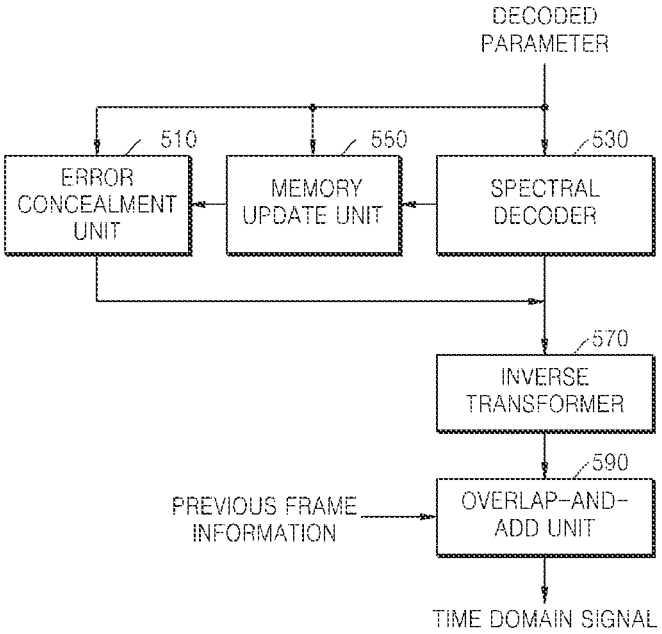
FIG. 5 is a block diagram of a frequency domain decoding apparatus according to an exemplary embodiment.

FIG. 5 is a block diagram of a frequency domain decoding apparatus according to an exemplary embodiment, which may correspond to the frequency domain decoder 234 of the audio decoding apparatus 230 of FIG. 2B or the frequency domain excitation decoder 334 of the audio decoding apparatus 330 of FIG. 3B.

The frequency domain decoding apparatus 500 shown in FIG. 5 may include an error concealment unit 510, a spectral decoder 530, a memory update unit 550, an inverse transformer 570, and an overlap-and-add unit 590. The components except for a memory (not shown) embedded in the memory update unit 550 may be integrated in at least one module and be implemented as at least one processor (not shown).

Referring to FIG. 5, first, if it is determined from a decoded parameter that no error has occurred in a current frame, a time domain signal may be finally generated by decoding the current frame through the spectral decoder 530, the memory update unit 550, the inverse transformer 570, and the overlap-and-add unit 590. In detail, the spectral decoder 530 may synthesize spectral coefficients by performing spectral-decoding of the current frame using the decoded parameter. The memory update unit 550 may update, for a next frame, the synthesized spectral coefficients, the decoded parameter, information obtained using the parameter, the number of continuous error frames till the present, characteristics of a previous frame (signal characteristics, e.g., transient, normal, and stationary characteristics, obtained by analyzing a synthesized signal in a decoder, type information of the previous frame (information, e.g., a transient frame and a normal frame, transmitted from an encoder), and so forth with respect to the current frame that is a good frame. The inverse transformer 570 may generate a time domain signal by performing a frequency-time transform on the synthesized spectral coefficients. The overlap-and-add unit 590 may perform an overlap-and-add process using a time domain signal of the previous frame and finally generate a time domain signal of the current frame as a result of the overlap-and-add process.

Otherwise, if it is determined from the decoded parameter that an error has occurred in the current frame, a bad frame indicator (BFI) of the decoded parameter is set to, for example, 1 indicating that no information exists in the current frame that is an error frame. In this case, a decoding mode of the previous frame is checked, and if the decoding mode of the previous frame is the frequency domain mode, a frame error concealment algorithm in the frequency domain may be performed on the current frame.

That is, the error concealment unit 510 may operate when the current frame is an error frame and the decoding mode of the previous frame is the frequency domain mode. The error concealment unit 510 may restore a spectral coefficient of the current frame by using the information stored in the memory update unit 550. The restored spectral coefficient of the current frame may be decoded through the spectral decoder 530, the memory update unit 550, the inverse transformer 570, and the overlap-and-add unit 590 to finally generate a time domain signal of the current frame.

If the current frame is an error frame, the previous frame is a good frame, and the decoding mode of the previous frame is the frequency domain mode, or if the current and previous frames are good frames, and the decoding mode thereof is the frequency domain mode, the overlap-and-add unit 590 may perform the overlap-and-add process by using the time domain signal of the previous frame that is a good frame. Otherwise, if the current frame is a good frame, the number of previous frames that are continuous error frames is 2 or greater, the previous frame is an error frame, and a decoding mode of a previous frame that is a latest good frame is the frequency domain mode, the overlap-and-add unit 590 may perform the overlap-and-add process by using the time domain signal of the current frame that is a good frame instead of performing the overlap-and-add process by using a time domain signal of a previous frame that is a good frame. These conditions may be represented by the following context:

```
if (bfi==0)&&(st→old_bfi_int>1)&&(st→prev_bfi==1)
&&
(st→last_core==FREQ_CORE)),
```

wherein bfi denotes an error frame indicator of a current frame, st→old_bfi_int denotes the number of previous frames that are continuous error frames, st→prev_bfi denotes BFI information of a previous frame, and st→last_core denotes a decoding mode of a core of a latest PGF, e.g., the frequency domain mode FREQ_CORE or the time domain mode TIME_CORE.

Figure 6:
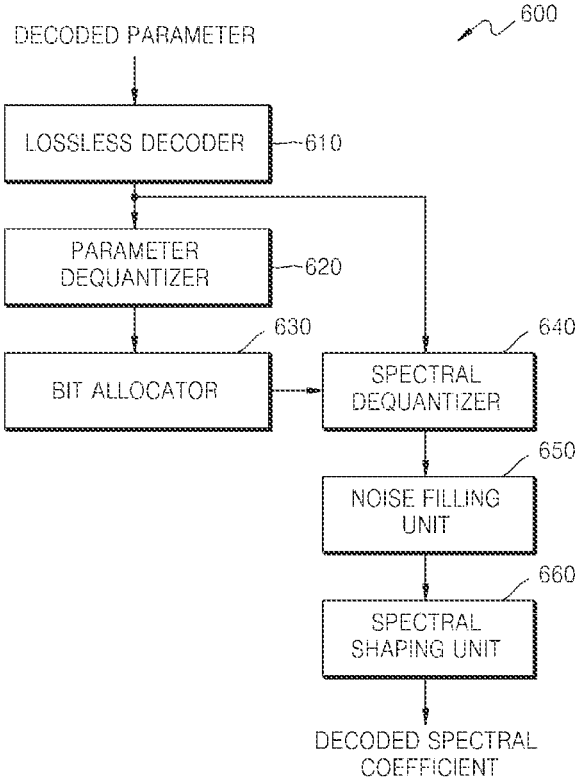
FIG. 6 is a block diagram of a spectral decoder according to an exemplary embodiment.

FIG. 6 is a block diagram of a spectral decoder 600 according to an exemplary embodiment.

The spectral decoder 600 shown in FIG. 6 may include a lossless decoder 610, a parameter dequantizer 620, a bit allocator 630, a spectral dequantizer 640, a noise filling unit 650, and a spectral shaping unit 660. The noise filling unit 650 may be disposed behind the spectral shaping unit 660. The components may be integrated in at least one module and be implemented as at least one processor (not shown).

Referring to FIG. 6, the lossless decoder 610 may lossless-decode a parameter, e.g., a norm value, on which lossless encoding has been performed in a encoding process.

The parameter dequantizer 620 may dequantize the lossless-decoded norm value. In an encoding process, the norm value may be quantized using any of various methods, e.g., vector quantization (VQ), scalar quantization (SQ), trellis coded quantization (TRQ), and lattice vector quantization (LVQ), and the quantized norm value may be dequantized using a corresponding method.

The bit allocator 630 may allocate bits required for each band based on the quantized norm value. In this case, the bits allocated for each band may be the same as bits allocated in the encoding process.

The spectral dequantizer 640 may generate a normalized spectral coefficient by performing a dequantization process using the bits allocated for each band.

The noise filling unit 650 may fill up a noise signal in a part requiring noise filling for each band.

The spectral shaping unit 660 may shape the normalized spectral coefficient by using the dequantized norm value. Finally, a decoded spectral coefficient may be obtained through a spectral shaping process.

Figure 7:
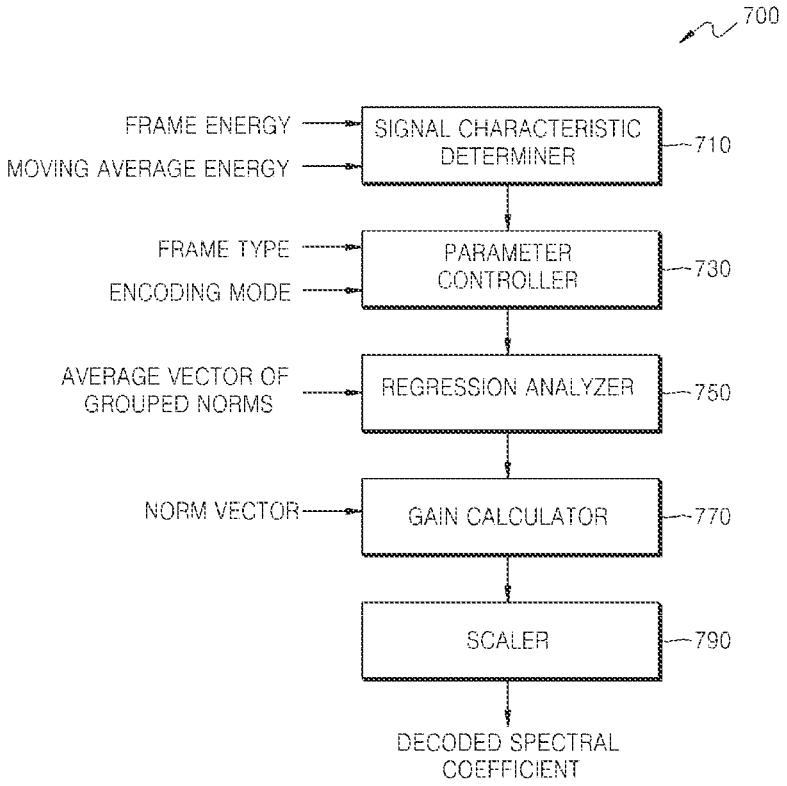
FIG. 7 is a block diagram of a frame error concealment unit according to an exemplary embodiment.

FIG. 7 is a block diagram of a frame error concealment unit 700 according to an exemplary embodiment.

The frame error concealment unit 700 shown in FIG. 7 may include a signal characteristic determiner 710, a parameter controller 730, a regression analyzer 750, a gain calculator 770, and a scaler 790. The components may be integrated in at least one module and be implemented as at least one processor (not shown).

Referring to FIG. 7, the signal characteristic determiner 710 may determine characteristics of a signal by using a decoded signal and classify characteristics of the decoded signal into transient, norm, stationary, and the like. A method of determining a transient frame will now be described below. According to an exemplary embodiment, whether a current frame is transient may be determined using frame energy and moving average energy of a previous frame. To do this, moving average energy Energy_MA and difference energy Energy_diff obtained for a good frame may be used. A method of obtaining Energy_MA and Energy_diff will now be described.

If it is assumed that a sum of energy or norm values of a frame is Energy_Curr, Energy_MA may be obtained by Energy_MA=Energy_MA*0.8+Energy_Curr*0.2. In this case, an initial value of Energy_MA may be set to, for example, 100.

Next, Energy_diff may be obtained by normalizing a difference between Energy_MA and Energy_Curr and may be represented by Energy_diff=(Energy_Curr−Energy_MA)/Energy_MA.

The signal characteristic determiner 710 may determine the current frame to be transient when Energy_diff is equal to or greater than a predetermined threshold ED_THRES, e.g., 1.0. Energy_diff of 1.0 indicates that Energy_Curr is double Energy_MA and may indicate that a change in energy of the current frame is very large as compared with the previous frame.

The parameter controller 730 may control a parameter for frame error concealment using the signal characteristics determined by the signal characteristic determiner 710 and a frame type and an encoding mode included in information transmitted from an encoder. The transient determination may be performed using to the information transmitted from the encoder or transient information obtained by the signal characteristic determiner 710. When the two kinds of information are simultaneously used, the following conditions may be used: That is, if is_transient that is transient information transmitted from the encoder is 1, or if Energy_diff that is information obtained by a decoder is equal to or greater than the predetermined threshold ED_THRES, e.g., 1.0, this indicates that the current frame is a transient frame of which a change in energy is severe, and accordingly, the number num_pgf of PGFs to be used for a regression analysis may be decreased. Otherwise, it is determined that the current frame is not a transient frame, and num_pgf may be increased.

```
if ((Energy_diff<ED_THRES)&&(is_transient==0))
{
  num_pgf=4;
}
else
{
  num_pgf=2;
}
```

In the above context, ED_THRES denotes a threshold and may be set to, for example, 1.0.

According to a result of the transient determination, the parameter for frame error concealment may be controlled. An example of the parameter for frame error concealment may be the number of PGFs used for a regression analysis. Another example of the parameter for frame error concealment may be a scaling method of a burst error duration. The same Energy_diff value may be used in one burst error duration. If it is determined that the current frame that is an error frame is not transient, when a burst error occurs, frames starting from, for example, a fifth frame, may be forcibly scaled as a fixed value of 3 dB regardless of a regression analysis of a decoded spectral coefficient of the previous frame. Otherwise, if it is determined that the current frame that is an error frame is transient, when a burst error occurs, frames starting from, for example, a second frame, may be forcibly scaled as a fixed value of 3 dB regardless of the regression analysis of the decoded spectral coefficient of the previous frame. Another example of the parameter for frame error concealment may be an applying method of adaptive muting and a random sign, which will be described below with reference to the scaler 790.

The regression analyzer 750 may perform a regression analysis by using a stored parameter of a previous frame. The regression analysis may be performed on every single error frame or performed only when a burst error has occurred. A condition of an error frame on which the regression analysis is performed may be defined in advance when a decoder is designed. If the regression analysis is performed on every single error frame, the regression analysis may be immediately performed on a frame in which an error has occurred. A parameter required for the error frame may be predicted using a function obtained according to a result of the regression analysis.

Otherwise, if the regression analysis is performed only when a burst error has occurred, when bfi_cnt indicating the number of continuous error frames is 2, that is, from a second continuous error frame, the regression analysis is performed. In this case, for a first error frame, a spectral coefficient obtained from a previous frame may be simply repeated, or a spectral coefficient may be scaled by a determined value.

```
if (bfi_cnt==2){
regression_anaysis( );
}if
```

In the frequency domain, a problem similar to continuous errors may occur even though the continuous errors have not occurred as a result of transforming an overlapped signal in the time domain. For example, if errors occur by skipping one frame, in other words, if errors occur in an order of an error frame, a good frame, and an error frame, when a transform window is formed by an overlapping of 50%, sound quality is not largely different from a case where errors have occurred in an order of an error frame, an error frame, and an error frame, regardless of the presence of a good frame in the middle. As shown in FIG. 16C to be described below, even though an nth frame is a good frame, if (n−1)th and (n+1)th frames are error frames, a totally different signal is generated in an overlapping process. Thus, when errors occur in an order of an error frame, a good frame, and an error frame, although bfi_cnt of a third frame in which a second error occurs is 1, bfi_cnt is forcibly increased by 1. As a result, bfi_cnt is 2, and it is determined that a burst error has occurred, and thus the regression analysis may be used.

```
if ((prev_old_bfi==1) && (bfi_cnt==1))
{
st→bfi_cnt++;
}
if (bfi_cnt==2)}
regression_anaysis( );
}
```

In the above context, prev_old_bfi denotes frame error information of a second previous frame. This process may be applicable when a current frame is an error frame.

The regression analyzer 750 may form each group by grouping two or more bands, derive a representative value of each group, and apply the regression analysis to the representative value, for low complexity. Examples of the representative value may be a mean value, an intermediate value, and a maximum value, but the representative value is not limited thereto. According to an exemplary embodiment, a mean vector of grouped norms that is an average norm value of bands included in each group may be used as the representative value.

When the properties of the current frame are determined using the signal characteristics determined by the signal characteristic determiner 710 and the frame type included in the information transmitted from the encoder, if it is determined that the current frame is a transient frame, the number of PGFs for the regression analysis may be decreased, and if it is determined that the current frame is a stationary frame, the number of PGFs for the regression analysis may be increased. According to an exemplary embodiment, when is_transient indicating whether the previous frame is transient is 1, i.e., when the previous frame is transient, the number num_pgf of PGFs may be set to 2, and when the previous frame is not transient, the number num_pgf of PGFs may be set to 4.

```
if (is_transient==1)
{
num_pgf=2;
}
else
{
num_pgf=4;
}
```

In addition, the number of rows of a matrix for the regression analysis may be set to, for example, 2.

As a result of the regression analysis by the regression analyzer 750, an average norm value of each group may be predicted for an error frame. That is, the same norm value may be predicted for each band belonging to one group in the error frame. In detail, the regression analyzer 750 may calculate values a and b from a linear regression analysis equation or a non-linear regression analysis equation to be described below through the regression analysis and predict an average grouped norm value of the error frame for each group by using the calculated values a and b.

The gain calculator 770 may obtain a gain between an average norm value of each group that is predicted for the error frame and an average norm value of each group in a PGF.

The scaler 790 may generate spectral coefficients of the error frame by multiplying the gain obtained by the gain calculator 770 by spectral coefficients of the PGF.

According to an exemplary embodiment, the scaler 790 may apply adaptive muting to the error frame or a random sign to a predicted spectral coefficient according to characteristics of an input signal.

First, the input signal may be identified as a transient signal and a non-transient signal. A stationary signal may be separately identified from the non-transient signal and processed in another method. For example, if it is determined that the input signal has a lot of harmonic components, the input signal may be determined as a stationary signal of which a change in the signal is not large, and an error concealment algorithm corresponding to the stationary signal may be performed. In general, harmonic information of the input signal may be obtained from the information transmitted from the encoder. When low complexity is not necessary, the harmonic information of the input signal may be obtained using a signal synthesized by the decoder.

When the input signal is largely classified into a transient signal, a stationary signal, and a residual signal, the adaptive muting and the random sign may be applied as described below. In the context below, a number indicated by mute_start indicates that muting forcibly starts if bfi_cnt is equal to or greater than mute_start when continuous errors occur. In addition, random_start related to the random sign may be analyzed in the same way.

```
if ((old_clas==HARMONIC) && (is_transient==0))/*
Stationary signal*/
{
mute_start=4;
random_start=3;
}
else if ((Energy_diff<ED_THRES) && (is_tran-
sient==0))/*Residual signal*/
{
mute_start=3;
random_start=2;
}
else /*Transient signal*/
{
mute_start=2;
random_start=2;
}
```

According to a method of applying the adaptive muting, spectral coefficients are forcibly down-scaled by a fixed value. For example, if bfi_cnt of a current frame is 4, and the current frame is a stationary frame, spectral coefficients of the current frame may be down-scaled by 3 dB.

In addition, a sign of spectral coefficients is randomly modified to reduce modulation noise generated due to repetition of spectral coefficients in every frame. Various well-known methods may be used as a method of applying the random sign.

According to an exemplary embodiment, the random sign may be applied to all spectral coefficients of a frame. According to another exemplary embodiment, a frequency band to which the random sign starts to be applied may be defined in advance, and the random sign may be applied to frequency bands equal to or higher than the defined frequency band, because it may be better to use a sign of a spectral coefficient that is identical to that of a previous frame in a very low frequency band, e.g., 200 Hz or less, or a first band since a waveform or energy may be largely changed due to a change in a sign in the very low frequency band.

Accordingly, a sharp change in a signal may be smoothed, and an error frame may be accurately restored to be adaptive to characteristics of the signal, in particular, a transient characteristic, and a burst error duration without an additional delay at low complexity in the frequency domain.

Figure 8:
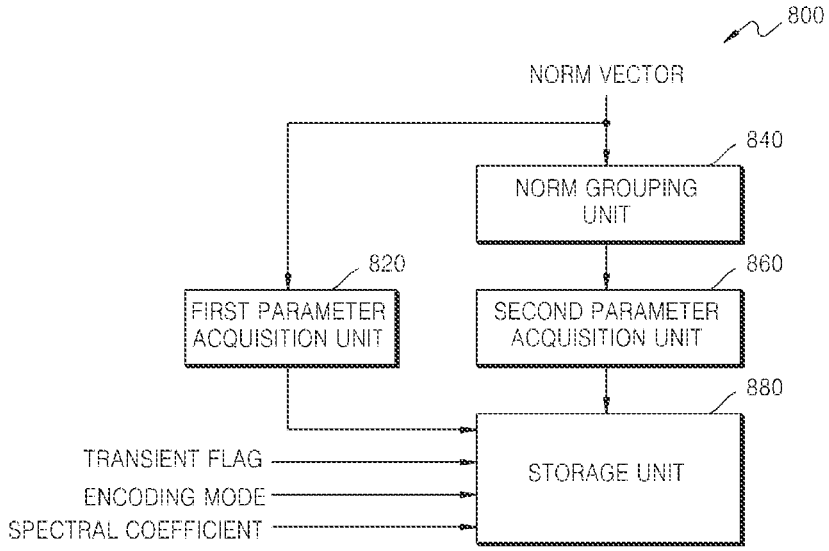
FIG. 8 is a block diagram of a memory update unit according to an exemplary embodiment.

FIG. 8 is a block diagram of a memory update unit 800 according to an exemplary embodiment.

The memory update unit 800 shown in FIG. 8 may include a first parameter acquisition unit 820, a norm grouping unit 840, a second parameter acquisition unit 860, and a storage unit 880.

Referring to FIG. 8, the first parameter acquisition unit 820 may obtain values Energy_Curr and Energy_MA to determine whether a current frame is transient and provides the obtained values Energy_Curr and Energy_MA to the storage unit 880.

The norm grouping unit 840 may group norm values in a pre-defined group.

The second parameter acquisition unit 860 may obtain an average norm value for each group and the obtained average norm value for each group is provided to the storage unit 880.

The storage unit 880 may update and store the values Energy_Curr and Energy_MA provided from the first parameter acquisition unit 820, the average norm value for each group provided from the second parameter acquisition unit 860, a transient flag indicating whether the current frame is transient, which is transmitted from an encoder, an encoding mode indicating whether the current frame has been encoded in the time domain or the frequency domain, and a spectrum coefficient of a good frame as values of the current frame.

Figure 9:
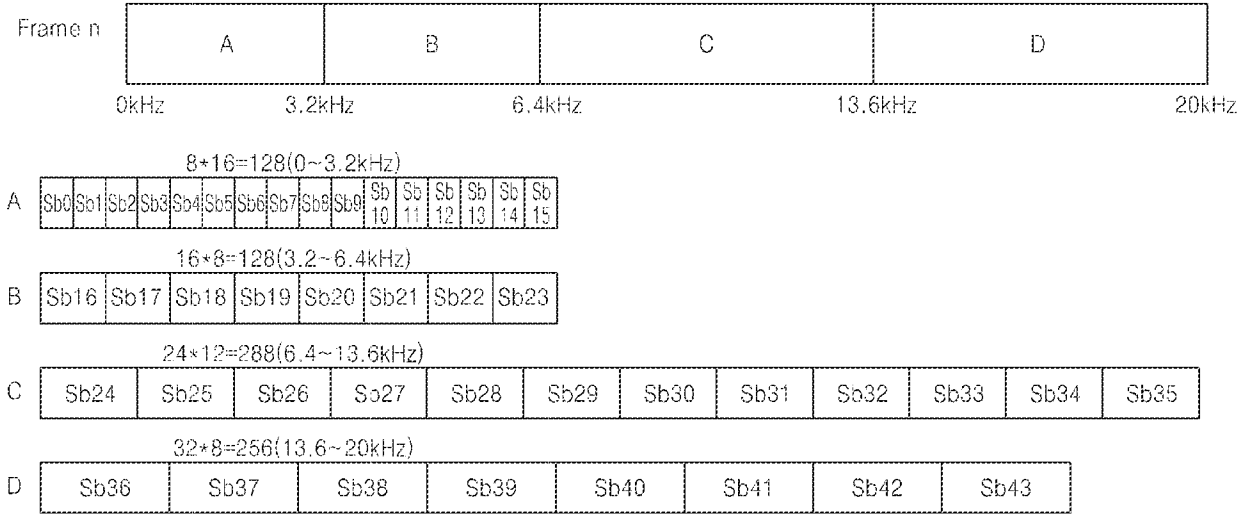
FIG. 9 illustrates band division which is applied to an exemplary embodiment.

FIG. 9 illustrates band division which is applied to the present invention. For a full-band of 48 KHz, an overlapping of 50% may be supported to a frame having a length of 20 ms, and when MDCT is applied, the number of spectral coefficients to be encoded is 960. If encoding is performed up to 20 KHz, the number of spectral coefficients to be encoded is 800.

In FIG. 9, a division A corresponds to a narrowband, supports 0 to 3.2 KHz, and is divided into 16 sub-bands with 8 samples per sub-band. A division B corresponds to a band added to the narrowband to support a wideband, additionally supports 3.2 to 6.4 KHz, and is divided into 8 sub-bands with 16 samples per sub-band. A division C corresponds to a band added to the wideband to support a super-wideband, additionally supports 6.4 to 13.6 KHz, and is divided into 12 sub-bands with 24 samples per sub-band. A division D corresponds to a band added to the super-wideband to support the full-band, additionally supports 13.6 to 20 KHz, and is divided into 8 sub-bands with 32 samples per sub-band.

Various methods are used to encode a signal divided into sub-bands. An envelope of a spectrum may be encoded using energy, a scale factor, or a norm for each band. After encoding the envelope of the spectrum, a fine structure, i.e., a spectral coefficient, for each band may be encoded. According to an exemplary embodiment, an envelope of the entire band may be encoded using a norm for each band. The norm may be obtained by Equation 1.

$$g_b = \sqrt{\frac{\sum_{i \in b} x_i^2}{N_b}} = 2^{0.5 n_b} \tag{1}$$

$$n_b = \lfloor 2\log_2 g_b + 0.5 \rfloor$$

$$n_b \leftrightarrow \hat{n}_b, \text{ via Quantization/Dequantization}$$

$$\hat{g}_b = 2^{\hat{n}_b}$$

$$y_i = x_i / \hat{g}_b,\ i \in b$$

In Equation 1, a value corresponding to the norm is $g_b$, and $n_b$ in a log scale is actually quantized. A quantized value of $g_b$ is obtained using the quantized value of $n_b$, and when an original input signal $x_i$ is divided by the quantized value of $g_b$, $y_i$ is obtained, and accordingly, a quantization process is performed.

Figure 10:
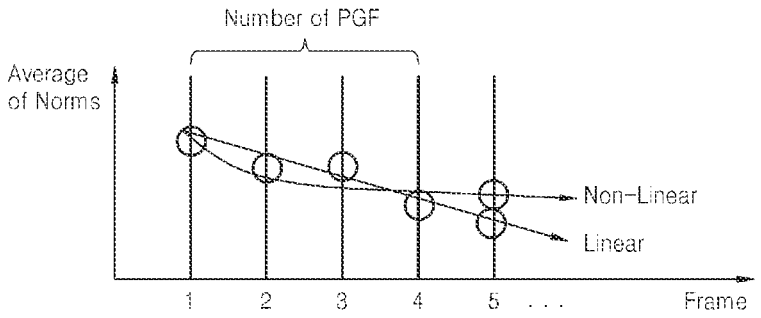
FIG. 10 illustrates the concepts of a linear regression analysis and a non-linear regression analysis which are applied to an exemplary embodiment.

FIG. 10 illustrates the concepts of a linear regression analysis and a non-linear regression analysis which are applied to the present invention, wherein 'average of norms' indicates an average norm value obtained by grouping several bands and is a target to which a regression analysis is applied. A linear regression analysis is performed when a quantized value of $g_b$ is used for an average norm value of a previous frame, and a non-linear regression analysis is performed when a quantized value of $n_b$ of a log scale is used for an average norm value of a previous frame, because a linear value in the log scale is actually a non-linear value. 'Number of PGF' indicating the number of PGFs used for a regression analysis may be variably set.

An example of the linear regression analysis may be represented by Equation 2.

$$y = ax + b \tag{2}$$

$$\begin{bmatrix} m & \sum x_k \\ \sum x_k & \sum x_k^2 \end{bmatrix} \begin{bmatrix} b \\ a \end{bmatrix} = \begin{bmatrix} \sum y_k \\ \sum x_k y_k \end{bmatrix}$$

As in Equation 2, when a linear equation is used, the upcoming transition may be predicted by obtaining a and b. In Equation 2, a and b may be obtained by an inverse matrix. A simple method of obtaining an inverse matrix may use Gauss-Jordan Elimination.

An example of the non-linear regression analysis may be represented by Equation 3.

$$y = bx^a \tag{3}$$

$$\ln y = \ln b + a \ln x$$

$$\begin{bmatrix} m & \sum \ln x_k \\ \sum x_k & \sum (\ln x_k)^2 \end{bmatrix} \begin{bmatrix} \ln b \\ a \end{bmatrix} = \begin{bmatrix} \sum \ln y_k \\ \sum (\ln x_k \ln y_k) \end{bmatrix}$$

$$y = \exp(\ln b + a \ln x)$$

In Equation 3, the upcoming transition may be predicted by obtaining a and b. In addition, a value of ln may be replaced by a value of $n_b$.

Figure 11:
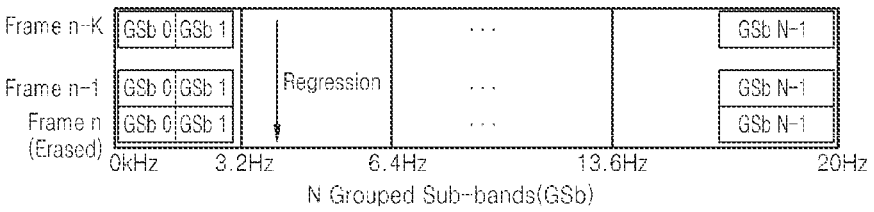
FIG. 11 illustrates a structure of sub-bands grouped to apply the regression analysis, according to an exemplary embodiment.

FIG. 11 illustrates a structure of sub-bands grouped to apply the regression analysis, according to an exemplary embodiment.

Referring to FIG. 11, for a first region, an average norm value is obtained by grouping 8 sub-bands as one group, and a grouped average norm value of an error frame is predicted using a grouped average norm value of a previous frame. Examples of using sub-bands for each band are shown in detail in FIGS. 12 to 14.

Figure 12:
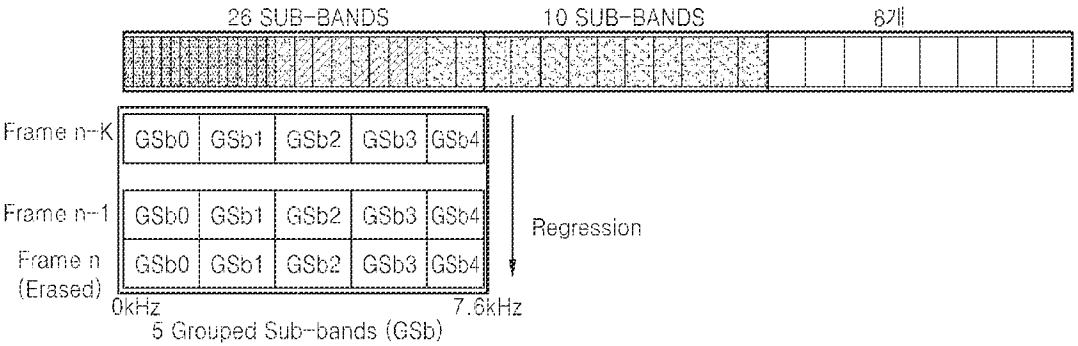
FIG. 12 illustrates a structure of sub-bands grouped to apply the regression analysis to a wideband supporting up to 7.6 KHz.
Figure 13:
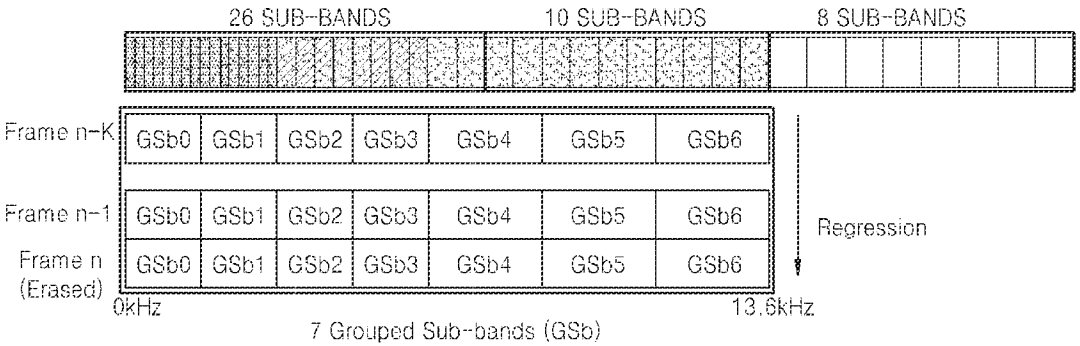
FIG. 13 illustrates a structure of sub-bands grouped to apply the regression analysis to a super-wideband supporting up to 13.6 KHz.
Figure 14:
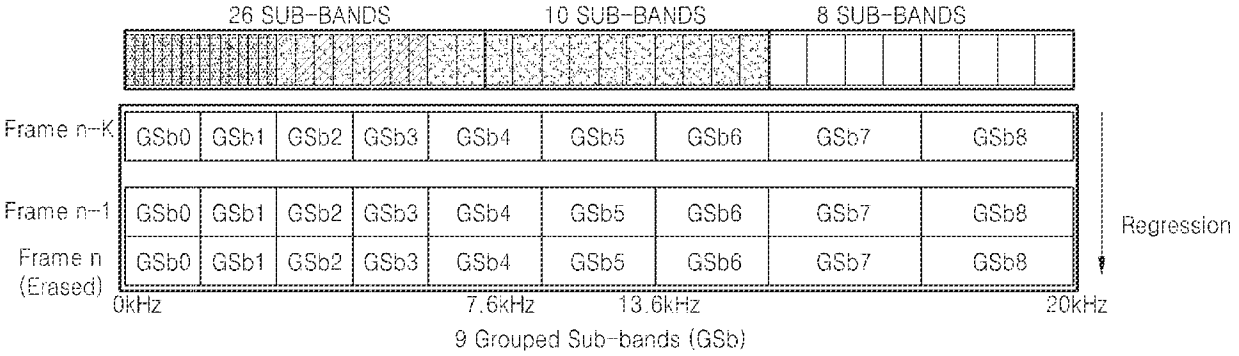
FIG. 14 illustrates a structure of sub-bands grouped to apply the regression analysis to a full-band supporting up to 20 KHz.

FIG. 12 illustrates a structure of grouped sub-bands when the regression analysis is applied to encode a wideband supporting up to 7.6 KHz. FIG. 13 illustrates a structure of grouped sub-bands when the regression analysis is applied to encode a super-wideband supporting up to 13.6 KHz. FIG. 14 illustrates a structure of grouped sub-bands when the regression analysis is applied to encode a full-band supporting up to 20 KHz.

Grouped average norm values obtained from grouped sub-bands form a vector, which is referred to as an average vector of grouped norms. When the average vector of grouped norms is substituted into the matrices described with respect to FIG. 10, the values a and b respectively corresponding to a slope and a y-intercept may be obtained.

Figure 15A:
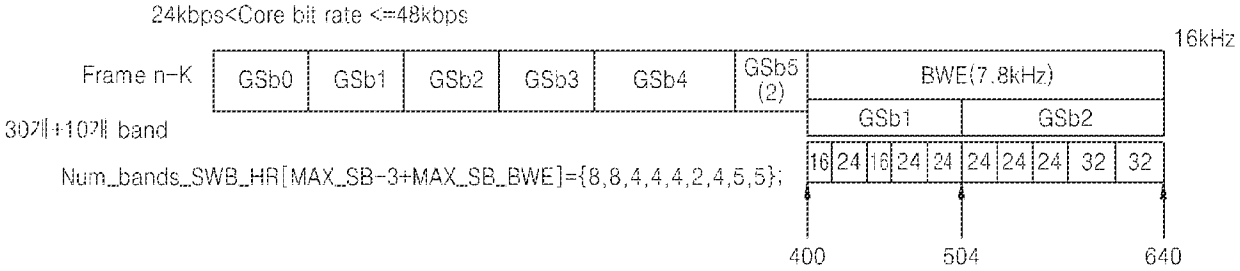
FIGS. 15A to 15C illustrate structures of sub-bands grouped to apply the regression analysis to a super-wideband supporting up to 16 KHz when bandwidth extension (BWE) is used.
Figure 15B:
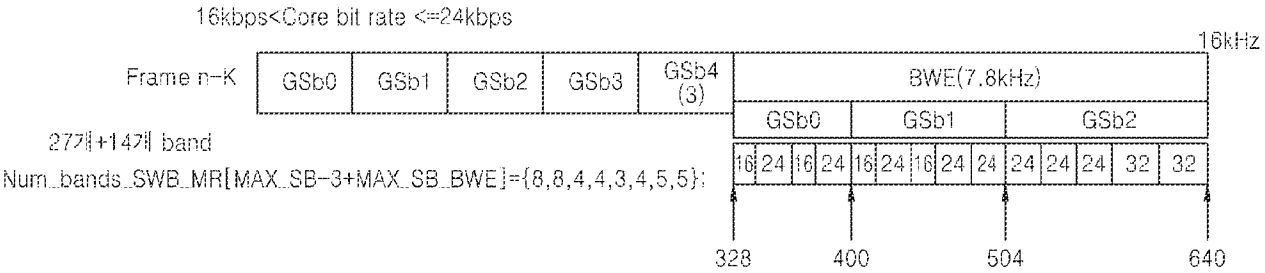
Figure 15C:
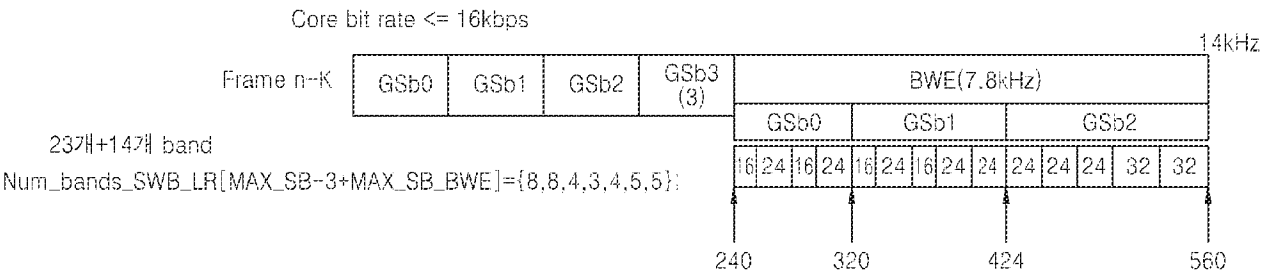

FIGS. 15A to 15C illustrate structures of sub-bands grouped to apply the regression analysis to a super-wideband supporting up to 16 KHz when BWE is used.

When MDCT is performed on a frame having a length of 20 ms with an overlapping of 50% in the super-wideband, 640 spectral coefficients total are obtained. According to an exemplary embodiment, grouped sub-bands may be determined by separating a core part from a BWE part. Encoding of a core starting portion to a BWE starting portion is called core encoding. Methods of representing a spectral envelope used for the core part and a spectral envelope used for the BWE part may be different from each other. For example, a norm value, a scale factor, or the like may be used for the core part, and likewise, a norm value, a scale factor, or the like may be used for the BWE part, wherein different ones may be used for the core part and the BWE part.

FIG. 15A shows an example in which a large number of bits are used for the core encoding, and the number of bits allocated to the core encoding is gradually reduced in FIG. 15B and FIG. 15C. The BWE part is an example of grouped sub-bands, wherein the number of sub-bands indicates the number of spectral coefficients. When a norm is used for a spectral envelope, a frame error concealment algorithm using a regression analysis is as follows: First, in the regression analysis, a memory is updated using a grouped average norm value corresponding to the BWE part. The regression analysis is performed using a grouped average norm value of the BWE part of a previous frame independently from the core part, and a grouped average norm value of a current frame is predicted.

Figure 16A:
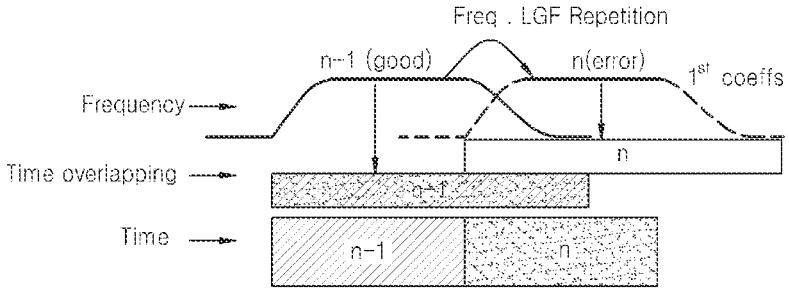
FIGS. 16A to 16C illustrate overlap-and-add methods using a time domain signal of a next good frame (NGF)
Figure 16B:
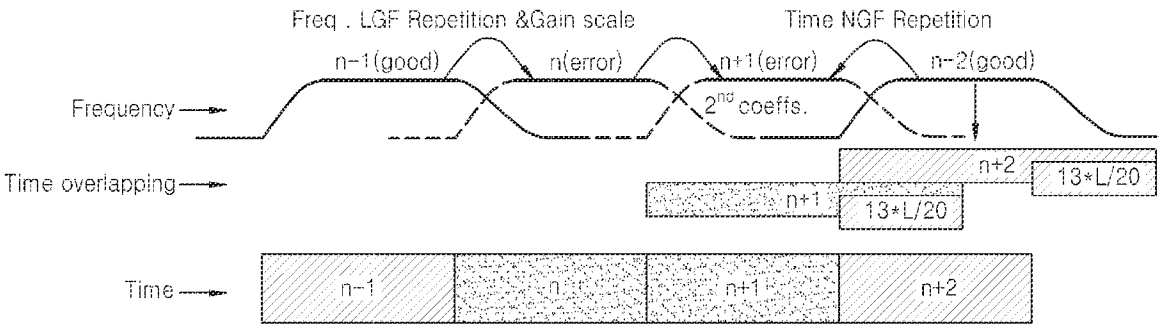
Figure 16C:
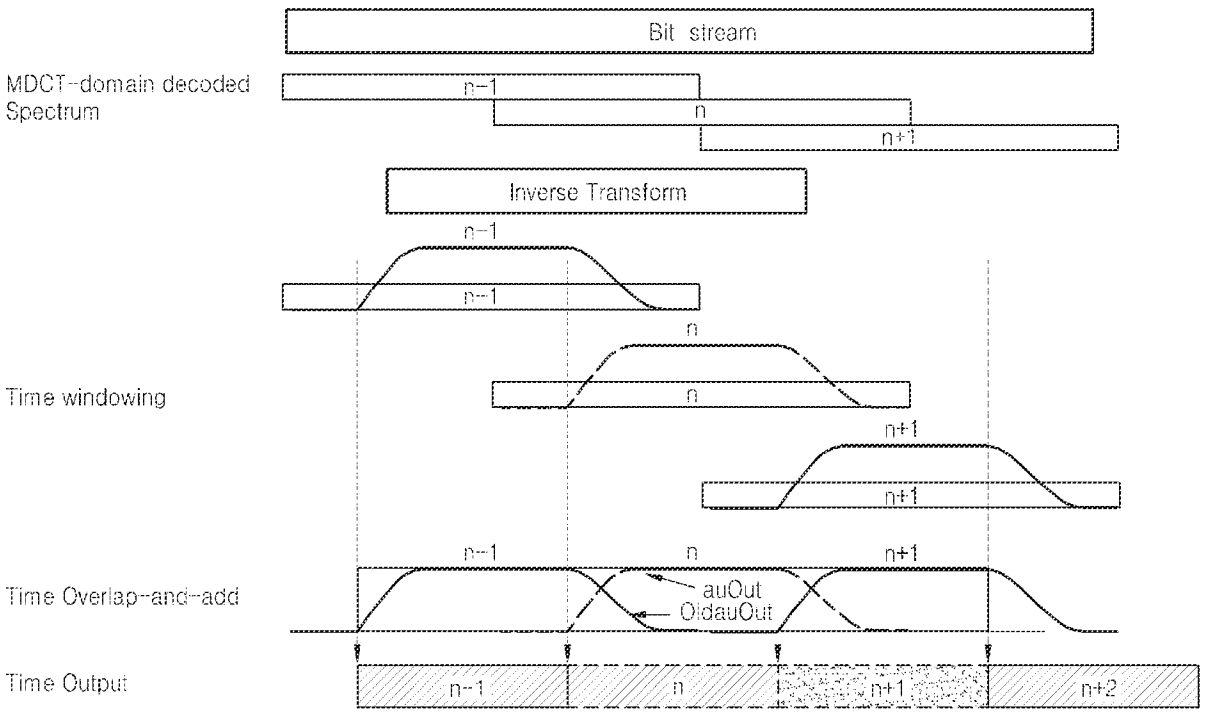

FIGS. 16A to 16C illustrate overlap-and-add methods using a time domain signal of a next good frame (NGF).

FIG. 16A describes a method of performing repetition or gain scaling by using a previous frame when the previous frame is not an error frame. Referring to FIG. 16B, not to use an additional delay, a time domain signal decoded in a current frame that is a good frame is repeatedly overlapped to the past for only a portion which has not been decoded through overlapping, and the gain scaling is additionally performed. A length of the signal to be repeated is selected as a value less than or equal to a length of a portion to be overlapped. According to an exemplary embodiment, the length of the portion to be overlapped may be 13*L/20, wherein L denotes, for example, 160 for a narrowband, 320 for a wideband, 640 for a super-wideband, and 960 for a full-band.

A method of obtaining a time domain signal of an NGF through repetition to derive a signal to be used for a time overlapping process is as follows:

In FIG. 16B, a block having a length of 13*L/20 in a future portion of an (n+2)th frame is copied to a future portion corresponding to the same position of an (n+1)th frame to replace an existing value by the block, thereby adjusting a scale. A scaled value is, for example, −3 dB. In the copy process, to remove discontinuity with the (n+1)th frame that is a previous frame, for a first length of 13*L/20, a time domain signal obtained from the (n+1)th frame of FIG. 16B is linearly overlapped with a signal copied from the future portion. Through this process, a signal for overlapping may be finally obtained, and when an updated (n+1)th signal is overlapped with an updated (n+2)th signal, a time domain signal of the (n+2)th frame is finally output.

As another example, referring to FIG. 16C, a transmitted bitstream is decoded to an "MDCT-domain decoded spectrum". For example, an overlapping of 50% is used, the actual number of parameters is double a frame size. When decoded spectral coefficients are inverse-transformed, a time domain signal having the same size is generated, and when a "time windowing" process is performed for the time domain signal, a windowed signal auOut is generated. When a "time overlap-and-add" process is performed for the windowed signal, a final signal "Time Output" is generated. Based on an nth frame, a portion OldauOut, which has not been overlapped in a previous frame, may be stored and used for a next frame.

Figure 17:
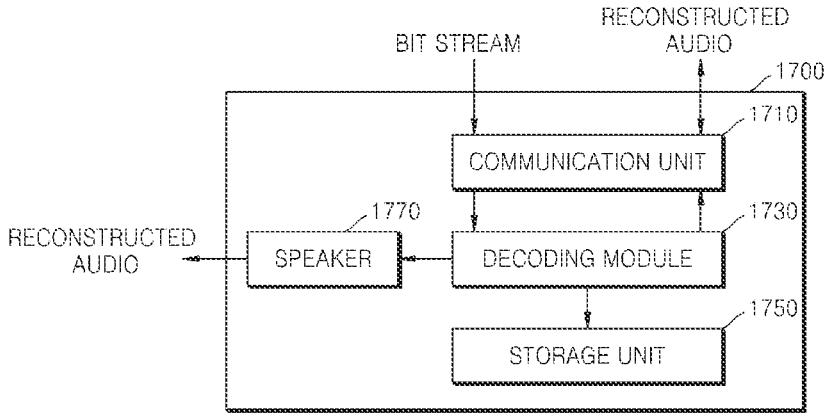
FIG. 17 is a block diagram of a multimedia device according to an exemplary embodiment.

FIG. 17 is a block diagram of a multimedia device 1700 according to an exemplary embodiment.

The multimedia device 1700 shown in FIG. 17 may include a communication unit 1710 and a decoding module 1730. In addition, the multimedia device 1700 may further include a storage unit 1750 for storing a reconstructed audio signal, which is obtained as a decoding result, according to the usage of the reconstructed audio signal. In addition, the multimedia device 1700 may further include a speaker 1770. That is, the storage unit 1750 and the speaker 1770 are optional. In addition, the multimedia device 1700 may further include an arbitrary encoding module (not shown), e.g., an encoding module for performing a general encoding function. The decoding module 1730 may be combined with other components (not shown) included in the multimedia device 1700 in one body and implemented as at least one processor (not shown).

Referring to FIG. 17, the communication unit 1710 may receive at least one of an encoded bitstream and an audio signal provided from the outside or transmit at least one of a reconstructed audio signal obtained as a decoding result of the decoding module 1730 and an audio bitstream obtained as an encoding result.

The communication unit 1710 is configured to transmit and receive data to and from an external multimedia device via a wireless network, such as wireless Internet, wireless Intranet, a wireless telephone network, a wireless local area network (WLAN), Wi-Fi, Wi-Fi Direct (WFD), third generation (3G), fourth generation (4G), Bluetooth, infrared data association (IrDA), radio frequency identification (RFID), ultra wideband (UWB), ZigBee, or near field communication (NFC), or a wired network, such as a wired telephone network or wired Internet.

The decoding module 1730 may be implemented using an audio decoding apparatus according to the various above-described embodiments of the present invention.

The storage unit 1750 may store a reconstructed audio signal generated by the decoding module 1730. In addition, the storage unit 1750 may store various programs required to operate the multimedia device 1700.

The speaker 1770 may output the reconstructed audio signal generated by the decoding module 1730 to the outside.

Figure 18:
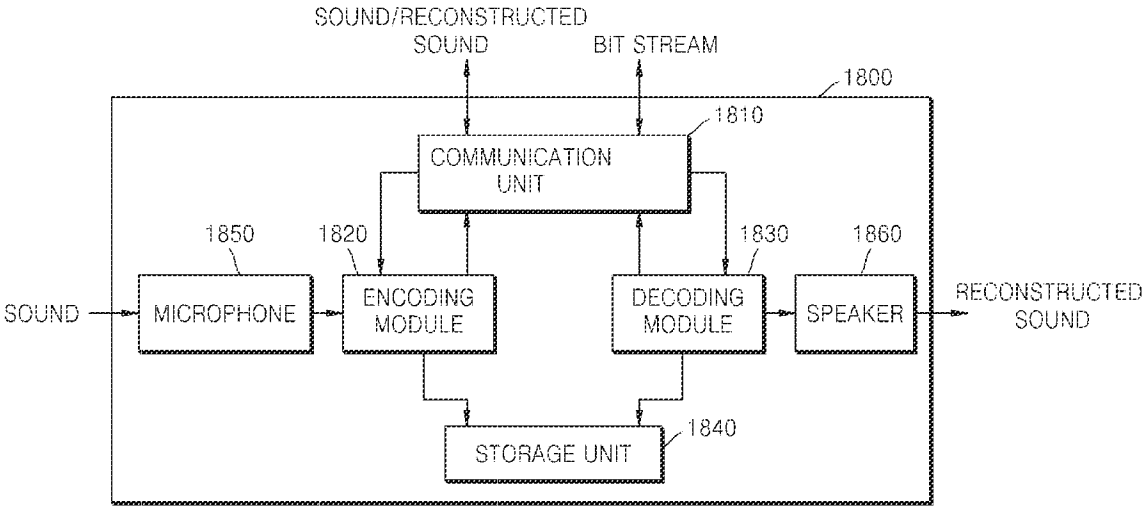
FIG. 18 is a block diagram of a multimedia device according to another exemplary embodiment.

FIG. 18 is a block diagram of a multimedia device 1800 according to another exemplary embodiment.

The multimedia device 1800 shown in FIG. 18 may include a communication unit 1810, an encoding module 1820, and a decoding module 1830. In addition, the multimedia device 1800 may further include a storage unit 1840 for storing an audio bitstream or a reconstructed audio signal, which is obtained as an encoding result or a decoding result, according to the usage of the audio bitstream or the reconstructed audio signal. In addition, the multimedia device 1800 may further include a microphone 1850 or a speaker 1860. The encoding module 1820 and the decoding module 1830 may be combined with other components (not shown) included in the multimedia device 1800 in one body and implemented as at least one processor (not shown). A detailed description of the same components between the multimedia device 1700 shown in FIG. 17 or the components of the multimedia device 1800 shown in FIG. 18 is omitted.

In FIG. 18, the encoding module 1820 may employ various well-known encoding algorithms to generate a bitstream by encoding an audio signal. The encoding algorithms may include, for example, Adaptive Multi-Rate-Wideband (AMR-WB), MPEG-2 & 4 Advanced Audio Coding (AAC), and the like but are not limited thereto.

The storage unit 1840 may store the encoded bitstream generated by the encoding module 1820. In addition, the storage unit 1840 may store various programs required to operate the multimedia device 1800.

The microphone 1850 may provide an audio signal of a user or the outside to the encoding module 1820.

Each of the multimedia devices 1700 and 1800 may further include a voice communication dedicated terminal including a telephone, a mobile phone, and so forth, a broadcast or music dedicated device including a TV, an MP3 player, and so forth, or a complex terminal device of the voice communication dedicated terminal and the broadcast or music dedicated device but is not limited thereto. In addition, each of the multimedia devices 1700 and 1800 may be used as a client, a server, or a transform device disposed between a client and a server.

When the multimedia device 1700 or 1800 is, for example, a mobile phone, although not shown, the mobile phone may further include a user input unit, such as a keypad, a user interface or a display unit for displaying information processed by the mobile phone, and a processor for controlling a general function of the mobile phone. In addition, the mobile phone may further include a camera unit having an image capturing function and at least one component for performing a function required for the mobile phone.

When the multimedia device 1700 or 1800 is, for example, a TV, although not shown, the TV may further include a user input unit, such as a keypad, a display unit for displaying received broadcast information, and a processor for controlling a general function of the TV. In addition, the TV may further include at least one component for performing a function required by the TV.

The methods according to the embodiments can be written as computer programs and can be implemented in general-use digital computers that execute the programs using a computer-readable recording medium. In addition, data structures, program instructions, or data files, which can be used in the embodiments of the present invention, can be recorded in the computer-readable recording medium in various manners. The computer-readable recording medium is any data storage device that can store data which can be thereafter read by a computer system. Examples of the computer-readable recording medium include magnetic recording media, such as hard disks, floppy disks, and magnetic tapes, optical recording media, such as CD-ROMs and DVDs, magneto-optical media, such as floptical disks, and hardware devices, such as read-only memory (ROM), random-access memory (RAM), and flash memory, specially configured to store and execute program instructions. In addition, the computer-readable recording medium may be a transmission medium for transmitting a signal indicating a program instruction, a data structure, or the like. Examples of the program instruction may include machine language code generated by a compiler and high-level language code which can be executed by a computer using an interpreter.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

What is claimed is:

1. A frame error concealment method comprising:

receiving a bitstream of an audio signal;

if it is determined that a current frame in the audio signal is an error frame and a number of contiguous error frames comprising the current frame is one, generating spectral coefficients of the current frame by repeating spectral coefficients of a previous frame;

if it is determined that the current frame in the audio signal is the error frame and the number of contiguous error frames comprising the current frame is equal to or greater than two, predicting a first parameter of the current frame, based on a regression analysis on second parameters of a plurality of previous frames; and generating the spectral coefficients of the current frame from spectral coefficients of at least one previous frame, based on the first parameter the current frame and at least one second parameter of at least one previous frame;

inverse-transforming the generated spectral coefficients of the current frame; and reconstructing the audio signal based on the inverse-transformed spectral coefficients of the current frame, wherein if it is determined that the current frame is the error frame, a first previous frame preceding the current frame is not the error frame, a second previous frame preceding the first previous frame is the error frame and the number of contiguous error frames is one, the regression analysis is applied for the current frame.

2. The frame error concealment method of claim 1, wherein the predicting the first parameter further comprises:

determining signal characteristics of the current frame; and determining how many of previous frames with no error are to be used for the regression analysis in response to the determined signal characteristics.

3. The frame error concealment method of claim 2, wherein the determining the signal characteristics is performed based on at least a transient flag transmitted from an encoder.

4. The frame error concealment method of claim 2, wherein the determining the signal characteristics is performed based on a frame type and an energy difference between a current frame energy and a moving average energy.

5. The frame error concealment method of claim 1, further comprising if it is determined that the current frame in the audio signal is the error frame and the to number of contiguous error frames comprising the current frame is the same or greater than two, determining a location to which adaptive muting is applied among the contiguous error frames, based on signal characteristics.

6. The frame error concealment method of claim 5, wherein if the location to which the adaptive muting is applied corresponds to the current frame, the current frame is muted to a fixed value.

7. The frame error concealment method of claim 1, wherein the predicting comprises performing a linear regression analysis.

* * * * *